United States Patent [19]

Lashley

[11] 4,175,467

[45] Nov. 27, 1979

[54] STRING MOUNTING APPARATUS

[75] Inventor: Ronald T. Lashley, Burlington, N.C.

[73] Assignee: Emmons Guitar Company, Inc., Burlington, N.C.

[21] Appl. No.: 907,927

[22] Filed: May 22, 1978

[51] Int. Cl.[2] ..... G10D 3/14

[52] U.S. Cl. ..... 84/312 P

[58] Field of Search ..... 84/298, 307, 312, 314, 84/205–208, 214, 297–299, 314 N, 312 P, 313

[56] References Cited

U.S. PATENT DOCUMENTS

| | | | |
|---|---|---|---|
| 462,519 | 11/1891 | Van Dusen | 84/214 |
| 509,414 | 11/1893 | Weber | 84/214 |
| 582,030 | 5/1897 | Walker | 84/314 |
| 3,014,395 | 12/1961 | Blair | 84/312 P |
| 3,048,073 | 8/1962 | Farr | 84/205 |
| 3,352,188 | 11/1967 | Fender | 84/312 P |
| 3,592,096 | 7/1971 | Ritter | 84/312 P |
| 4,077,296 | 3/1978 | Mullen | 84/312 P |
| 4,080,864 | 3/1978 | Jackson | 84/312 P |
| 4,106,387 | 8/1978 | Alifano | 84/312 P |

*Primary Examiner*—Lawrence R. Franklin

[57] ABSTRACT

The invention as described herein consists of a string mounting apparatus as may be used with stringed musical instruments to improve the quality of the sounds emanating therefrom and to provide high quality reproductions of sounds as the musical instrument is played.

2 Claims, 3 Drawing Figures

STRING MOUNTING APPARATUS

BACKGROUND AND OBJECTIVES OF THE INVENTION

In tuning stringed musical instruments, such as pedal guitars, the strings are initially adjusted to reproduce certain notes such as a C note by turning an external tuning screw which is located conventionally on the neck of the guitar. Rotating the tuning screw causes the string to either tighten or slacken depending upon the direction the screw is rotated. After the string has been adjusted in the "free" condition ("free" referring to the string not having a pedal as would be connected thereto depressed) the string is then adjusted by depressing one or more pedals which may be connected thereto to either raise or lower the tension of the string to produce, for example, a B flat or C sharp note, which is tuned by adjusting foot pedal rods or other means provided to properly tension the string when the pedal or pedals are depressed. After adjusting the strings with the pedals depressed, the instrument is then conventionally considered ready for use. However, if a frequency meter is used to measure the vibrations of the string producing the C note in the free condition before and after pedal tuning, a difference in the tones produced would be readily visible on conventional musical instruments. Also, the tonal qualities of most instruments during playing vary in pitch both upwardly and downwardly over relatively short periods of use and various attempts have been made to reduce the variables which cause tension changes in the strings both during and after tuning.

However, these attempts have for the most part been unsuccessful and tonal variations continue to haunt musicians and manufacturers alike.

With this background in mind the present invention was developed and one of its objectives is to provide a string mounting apparatus for musical instruments which will provide uniform sounds of notes within a narrow frequency range over long periods of use;

It is another objective of the present invention to provide a string mounting apparatus which includes a string locking mechanism to prevent longitudinal movement of the string when it is engaged and thus prevent sliding friction over the nut means as the string is tensioned or loosened by the pedal;

As a further objective of the present invention, overtones which are often produced by string vibration between the nut means and the axle post of conventional guitars are eliminated by the construction of this invention.

Still yet a further objective of the present invention is to maintain the vibrational energy of the string between the string securing bridge member and the nut means of the guitar.

It is yet another objective of the present invention to provide a string mounting apparatus having a tone adjusting means which will pivot smoothly during the raising or lowering of the tonal quality of the string and which creates a minimum of "drag" or friction during its operation;

It is still another objective of the present invention to provide a string mounting apparatus which is simple in construction and is inexpensive to manufacture;

It is another objective of the present invention to provide a string mounting apparatus which will permit ease and accuracy in tuning and will maintain the strings in-tune over an extended period of time.

SUMMARY OF THE INVENTION AND DESCRIPTION OF THE DRAWINGS

This invention consists of a string mounting apparatus for a pedal guitar or other musical instruments employing strings whereby a string is connected to a nut means on the neck portion of the instrument and the nut means includes a tuning screw and a string locking mechanism. The string is tuned in the "free" condition by adjusting the tuning screw with the locking mechanism disengaged from the string. When the string has been properly tuned in the free condition, the locking mechanism is engaged and the string is then tightly secured to the neck nut means to prevent it from loosening or tightening when the musical instrument is played. The opposite end of the string from that connected to the neck nut means is secured to a tone adjusting means which is manipulated through connecting rods by depressing levers or pedals on the musical instrument. The tone adjusting means includes a string securing bridge member which is pivotally mounted on a string securing member axle and is rotatably attached to a tone raising member which, when urged by the depression of the connected pedal, causes the string securing bridge member to pivot in a clockwise direction around the axle to tighten the string attached thereto and to raise the pitch of the string as it is played. Spaced from the tone adjusting means and pivotally connected to the tone raising member is a tone lowering member which is controlled through connecting rods from a pedal that, when said pedal is depressed, rotates the tone lowering member in a clockwise direction which in turn causes the string securing bridge member to pivot in a counterclockwise direction thus lowering tension on the string creating a lower tone as the string is played. As will be understood by those skilled in the art, depression of both the lowering and raising pedals upon proper adjustment of the lowering and raising rods will neutralize the effect of the string securing member and the string will then emanate a tone as if in the "free" condition.

Unlike conventional units, the tone adjusting means of the present invention eliminates misplacement or incorrect displacement and return of its pivoting members eliminates friction or "drag" and provides a truer frequency and a more consistent tone for each note as it is played during, for example, an evening's performance.

Figure 1:
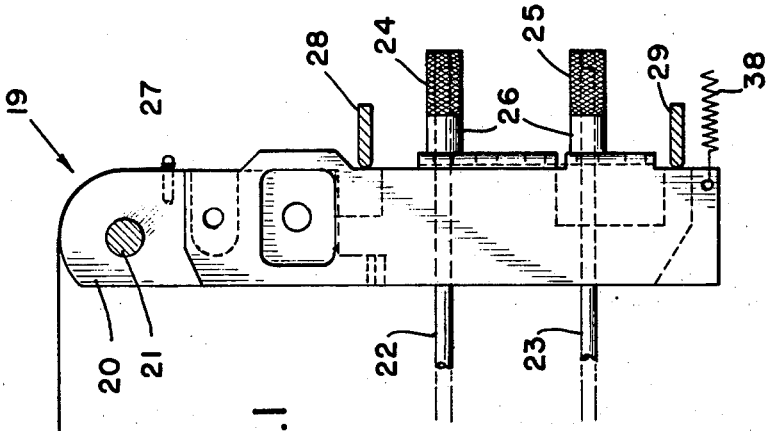
FIG. 1 shows a string mounting apparatus including a tone adjusting means and neck nut means.

Turning now to the drawings, FIG. 1 demonstrates a string mounting apparatus of the preferred embodiment for musical instruments such as a pedal guitar or other stringed instruments and includes a neck nut means 10 with a base member 10-A having a tuning screw 11 with a head 12 and threads 13 which cooperatively react with worm gear 14 which rotates around its axle post 15 around which is wrapped the terminal end of guitar string 16. The tuning screw 11 and worm gear 14 comprises the string tuning adjusting means 17 which can be used to tighten or loosen string 16 when hold down member 18 is disengaged from string 16. As shown in FIG. 1, hold down member 18 consists of a set screw which may be replaced with a thumb screw or other means which will function to "lock-down" string 16 once it is properly tuned in the free condition by tuning adjusting means 17. This mechanism provides the tonal advantages of a "keyless" guitar, but maintains the ease of tuning a conventional guitar.

Connected to the opposite end of string 16 is tone adjusting means 19 which is shown in the assembled condition in FIG. 1. String securing bridge member 20 is pivotally mounted on string securing bridge member axle 21 whereby string securing bridge member 20 can rotate clockwise or counterclockwise around axle 21 to raise or lower the tone of string 16. As will be understood, depression of the pedal (not shown) which is connected to raising rod 22 urges string securing bridge member 20 in a clockwise direction whereas depression of the pedal (not shown) connected to lowering rod 23 causes string securing bridge member 20 to rotate in a counterclockwise direction, thus lowering the tone of string 16. When rod 23 is actuated (pull) then first tone changing or lowering member 30 pivots clockwise around stop/pivot member 28 causing the second tone changing or raising member 31 to rotate in a clockwise direction pivotally around stop member 29, thus causing string securing bridge member 20 to pivot counterclockwise around bridge member axle 21, thus lowering the tension on string 16. When raising rod 22 is actuated, tone raising member 31 rotates around pivotal member 34 in a clockwise direction causing string securing bridge member 20 to rotate in a clockwise direction thus tightening the tension on string 16. During this tone raising movement, tone lowering member 31 does not move.

Raising rod 22 has an adjusting cap 24 and lowering rod 23 has an adjusting cap 25 which are threaded and which are used by the musician to tune the string 16 further after it has been tuned in its "free" condition. Also shown on rods 22 and 23 are spacer means 26.

Figure 2:
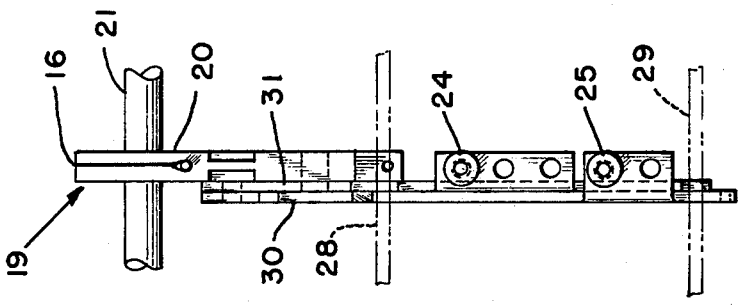
FIG. 2 illustrates a rear elevational view of the tone adjusting means in assembled form.

An end view of the tone adjusting means 19 is shown in FIG. 2 and a top view of string connector 27 is shown joined to string 16. Also shown in FIG. 2 is a stop/pivot member 28, tone raising member 31 and string securing bridge member 20. In the neutral position (all pedals released) stop member 29 prevents counterclockwise rotation of tone lowering member 30 and tone raising member 31. Stop/pivot member 28 is stationary and allows rotation of lowering member 30. As can be seen, tone lowering member 30 does not contact string securing bridge member 20, yet tone raising member 31 is in contact with both string securing member 20 and tone lowering member 30 in this, the preferred embodiment.

Figure 3:
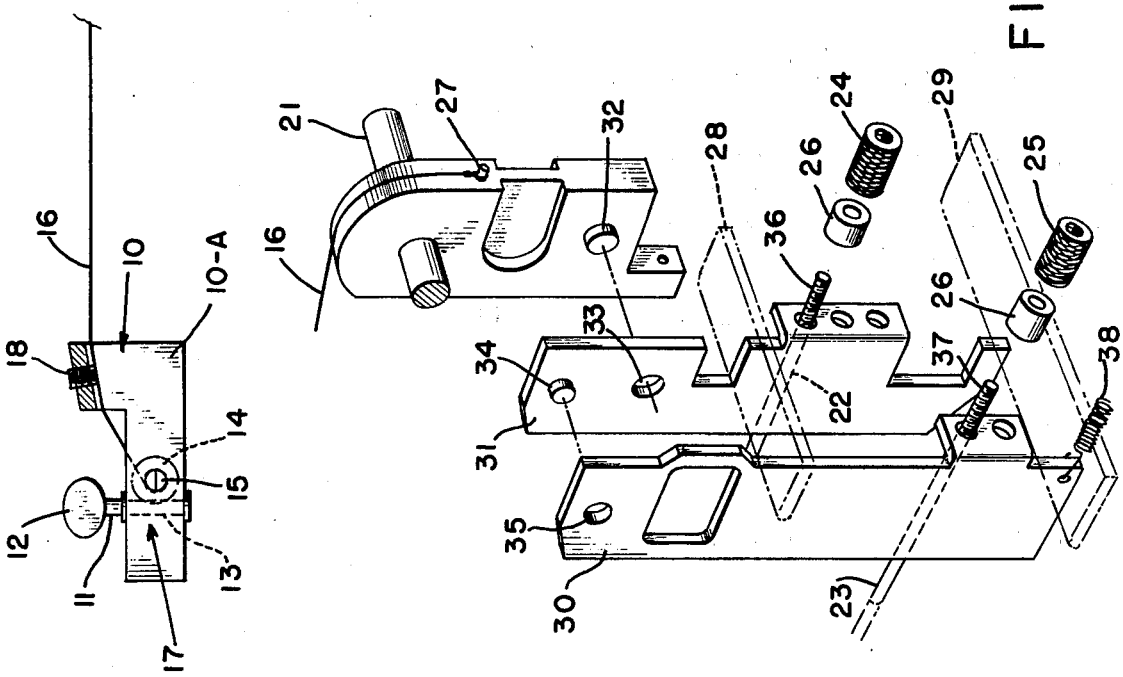
FIG. 3 demonstrates the tone adjusting means in exploded fashion.

In FIG. 3, an exploded view is shown of the tone adjusting means 19 with tone raising member 31 shown spaced both from string securing bridge member 20 and tone lowering member 30. Tone raising member 31 is pivotally fastened to string securing bridge member 20 by pivot member 32 which slips into opening 33 of tone raising member 31. Pivotal member 34 on tone raising member 31 on assembly of the tone adjusting means likewise fits into opening 35 of the tone lowering member 30 and provides for rotatable movement between the lowering and raising members.

As seen in FIG. 3, tone raising rod 22 has a threaded end 36 on which adjusting cap 24 is positioned. Likewise, tone lowering rod 23 includes a threaded end 37 upon which adjusting cap 25 attaches. Below tone lowering rod 23 and affixed to tone lowering member 30 is resilient member 38 which returns the tone adjusting means to its neutral position when the pedals (not shown) which are connected to either or both lowering rod 23 or raising rod 22 are released.

Other improvements and advantages of the present invention will be apparent to those skilled in the art and the descriptions and illustrations contained herein along with specific examples are not for the purpose of limitation.

I claim:

1. A tone adjusting mechanism for a pedal-type musical instrument, comprising:

a string securing bridge member pivotally mounted on an axle, said bridge member adapted to receive a tensioned string thereon;

a first tone changing member pivotally connected to said bridge member;

a second tone change member pivotally connected to said first tone member;

stop means spaced from said axle for providing a rest position for said first and second tone changing members and for providing a pivot fulcrum for said first tone changing member when said second tone changing member is actuated; and pivot/stop means generally located intermediate said axle and said stop means for providing a pivot fulcrum for said second tone changing member when said second tone changing member is actuated.

2. A tone adjusting means as claimed in claim 1, wherein said first tone changing member is a tone raising member and said second tone changing member is a tone lowering member.

* * * * *